US005481855A

United States Patent [19]

Yuyama

[11] Patent Number: 5,481,855

[45] Date of Patent: Jan. 9, 1996

[54] TABLET PACKING DEVICE AND METHOD FOR CONTROLLING THE SAME

[76] Inventor: Shoji Yuyama, 3-8, Honan-cho Nishi 4-chome, Toyonaka-shi, Osaka, Japan

[21] Appl. No.: 312,993

[22] Filed: Sep. 27, 1994

[51] Int. Cl.[6] ..... B65B 1/06; B65B 1/40; B65B 35/12; B65B 57/10

[52] U.S. Cl. ..... 53/493; 53/52; 53/168; 53/237

[58] Field of Search ..... 53/493, 52, 168, 53/501, 502, 503, 77, 237, 240, 238, 154, 155

[56] References Cited

U.S. PATENT DOCUMENTS

| | | | |
|---|---|---|---|
| 2,523,517 | 9/1950 | Potter | 53/168 X |
| 4,548,286 | 10/1985 | Sashiki et al. | 53/502 |
| 4,607,478 | 8/1986 | Maglecic | 53/502 |
| 5,010,929 | 4/1991 | Tisma | 53/168 X |
| 5,097,652 | 3/1992 | Inamura et al. | 53/493 |
| 5,174,472 | 12/1992 | Raque et al. | 53/493 X |
| 5,209,046 | 5/1993 | Tapscott et al. | 53/493 X |

*Primary Examiner*—James F. Coan
*Attorney, Agent, or Firm*—Wenderoth, Lind & Ponack

[57] ABSTRACT

A tablet packing device is proposed which accommodates a plurality of types of tablets and selectively discharges them from feeders for packing. A tablet is discharged from one of the feeders into a hole formed in a pocket plate. Since a shutter plate covers the hole, the tablet bounces on the shutter plate and settles down after a while. Thereafter, the shutter plate is rotated to open the hole to drop the tablet to a hopper. The tablet is then slid down along the inner wall of the hopper and, when a hopper cover provided at the bottom of the hopper is opened, it is dropped further therethrough. After the tablet has reached inside of the packing sheet which is folded into two, it is sealed in one packing bag as the heater rollers rotate. It is possible to save the time required to pack the tablets according to the tablet types by presetting the time required for each type of tablet to settle down from landing and discharging the tablet after lapse of the preset time.

6 Claims, 7 Drawing Sheets

31

| Tablet name | Feeder No. | Characteristic |
|---|---|---|
| A | 1−1 3−1 | $T_1$ |
| B | 1−1 3−4 | $T_1$ |
| C | 1−1 3−3 | $T_3$ |
| D | 1−1 3−5 | $T_4$ |
| E | 1−2 3−1 | $T_1$ |
| F | 1−2 3−4 | $T_1$ |
| G | 1−n 3−1 | $T_2$ |
| ⋮ | ⋮ | ⋮ |

FIG. 5

| Tablet characteristic | Tablet type | Stabilization time |
|---|---|---|
| $T_1$ | Elliptical capsule | 0 sec |
| $T_2$ | Sugar-coated tablet | 0.1 sec |
| $T_3$ | Elliptical soft capsule | 0.2 sec |
| $T_4$ | Spherical soft capsule | 0.3 sec |

32

FIG. 6

| Feeder No. | Characteristic |
|---|---|
| 1-1,3-1 | $H_1$ |
| 1-1,3-2 | $H_2$ |
| 1-1,3-3 | $H_3$ |
| 1-1,3-4 | $H_4$ |
| 1-1,3-5 | $H_5$ |
| 1-2,3-1 | $H_1$ |
| 1-2,3-2 | $H_2$ |
| ⋮ | ⋮ |

33

FIG. 7

| Feeder characteristic | Feeder height | Delay time "tr" | Dropping time "ts" |
|---|---|---|---|
| $H_1$ | Low | 0.4 sec | 0 sec |
| $H_2$ | Mid-low | 0.3 sec | 0.1 sec |
| $H_3$ | Medium | 0.2 sec | 0.2 sec |
| $H_4$ | Mid-high | 0.1 sec | 0.3 sec |
| $H_5$ | High | 0 sec | 0.4 sec |

34

35

| Feeder characteristic | Feeder height | Correction coefficient |
|---|---|---|
| $H_1$ | Low | 1.0 |
| $H_2$ | Mid-low | 1.1 |
| $H_3$ | Medium | 1.2 |
| $H_4$ | Mid-high | 1.3 |
| $H_5$ | High | 1.4 |

TABLET PACKING DEVICE AND METHOD FOR CONTROLLING THE SAME

BACKGROUND OF THE INVENTION

This invention relates to a tablet packing device which accommodates a plurality of types of tablets and selectively discharges them for packing, and a method for controlling the same.

A conventional "tablet packing machine" of this kind is disclosed in Examined Japanese Utility Model Publication 1-8482 in which tablet cases each accommodating one type of tablets are categorized into groups according to the distance from the packing position. A time required to transport a tablet from each tablet case to the packing sheet is preset for each tablet group. If a tablet is discharged from the tablet case, it is packed after the preset time specified therefor has lapsed. In this manner, the tablets are discharged from the tablet cases and packed without wasting time.

When tablets are let drop out of the tablet cases, some tablets leap out while others settle down quickly. For example, spherical soft capsules are likely to bounce, but elliptical capsules are not. Therefore, the bouncy capsules require a relatively long time to reach the packing sheet after discharged, but the capsules which settle down quickly take only a short time.

In such a conventional tablet packing device, the distance between the tablet case and the packing sheet is taken into a great consideration to cut the packing time, but no attention was paid to the tablet types. Namely, the time periods during which the dropped tablets reach the packing sheet are differentiated not according to the degree of bounce but according to the distance only. Should different types of tablets be transported for the same distance, the least bouncy tablet has to wait the longest time until it is packed. The time period is adjusted to the most bouncy tablet because it needs the longest time to settle down in comparison with others travelling the same distance.

It is an object of the present invention to provide a tablet packing device and a method for controlling it with which the time for a series of packing operations can be reduced.

SUMMARY OF THE INVENTION

In order to solve the abovesaid problems, there is provided a tablet packing device having a plurality of feeders accommodating different types of tablets, the tablets being selectively dropped from the feeders and packed, the packing device further comprising:

memory means for storing data of a time period for each type of tablets to settle down from the instant when a dropped tablet has landed; and control means for controlling the feeders to discharge one of the tablets from one of the feeders, to read out the time period specified for the one tablet from the memory means, and to drop the next one of the tablets from another one of the feeders after the time period has lapsed.

In the method for controlling a tablet packing device, a time period is determined beforehand for each type of tablets to settle down from the instant when the tablet after dropped; and a timing for dropping a tablet after a preceding tablet is dropped from one of the feeders is based upon the time period.

Further, in the aforementioned tablet packing device, the tablets are categorized into groups according to the time required to settle down after they are dropped, and the sooner the tablets settle, the tablets are accommodated in the higher feeders.

Also, the tablets are categorized into groups according to the time required to settle down after they are dropped and the frequency in use, and the sooner the tablets settle and the less frequently the tablets are used, the tablets are accommodated in the higher the feeders.

With the tablet packing device of the present invention, the control unit reads out from the memory unit the time for the dropped tablet to settle down after it has reached the sheet. After this "stabilization time period" has elapsed, the control unit will command to drop the next tablet from another feeder. Thus, if the dropped tablet requires a short stabilization time, only a short time interval is needed before the next tablet is dropped. If a long stabilization time is taken, a long time interval is required.

According to the control method in the present invention, the exact timing to drop the tablet is determined by the stabilization time period of the preceding tablet which has been dropped and reached the sheet. Thus, the timing to drop tablets can be changed depending upon the type of tablets.

Moreover, the less bouncy tablets should be accommodated in the higher feeders and the more bouncy ones be in the lower feeders. With this arrangement, the impact on the less bouncy tablets in the higher feeders is strong but they require a relatively short time to stabilize. In contrast, the impact on the bouncy tablets in the lower feeders is so weak that they can stabilize quickly. In short, the stabilization time periods for all types of tablets are compensated to become substantially the same.

It is more preferable that the tablets which are less bouncy and not in frequent use are accommodated in the higher feeders and that the bouncy and frequently-used tablets are accommodated in the lower feeders. Although the tablets in the lower feeders are dropped more frequently, the entire processing time is kept short because they have a short stabilization time period.

Each type of tablets has a predetermined stabilization time period. If one tablet is dropped, the next tablet is discharged after the time interval is over which has been set beforehand according to this time period. Therefore, time is not wasted after it has settled down. This will reduce the time for packing the tablets.

The lower feeder accommodates tablets which have a longer stabilization time period and are used more frequently. This will speed up the processing time as a whole.

BRIEF DESCRIPTION OF THE DRAWINGS

Other features and objects of the present invention will become apparent from the following description made with reference to the accompanying drawings, in which:

FIG. 3 is a perspective view of a heater roller of the same;

FIGS. 4–7 show data tables in the memory unit of the embodiment;

DETAILED DESCRIPTION OF THE PREFERRED EMBODIMENT

Figure 1:
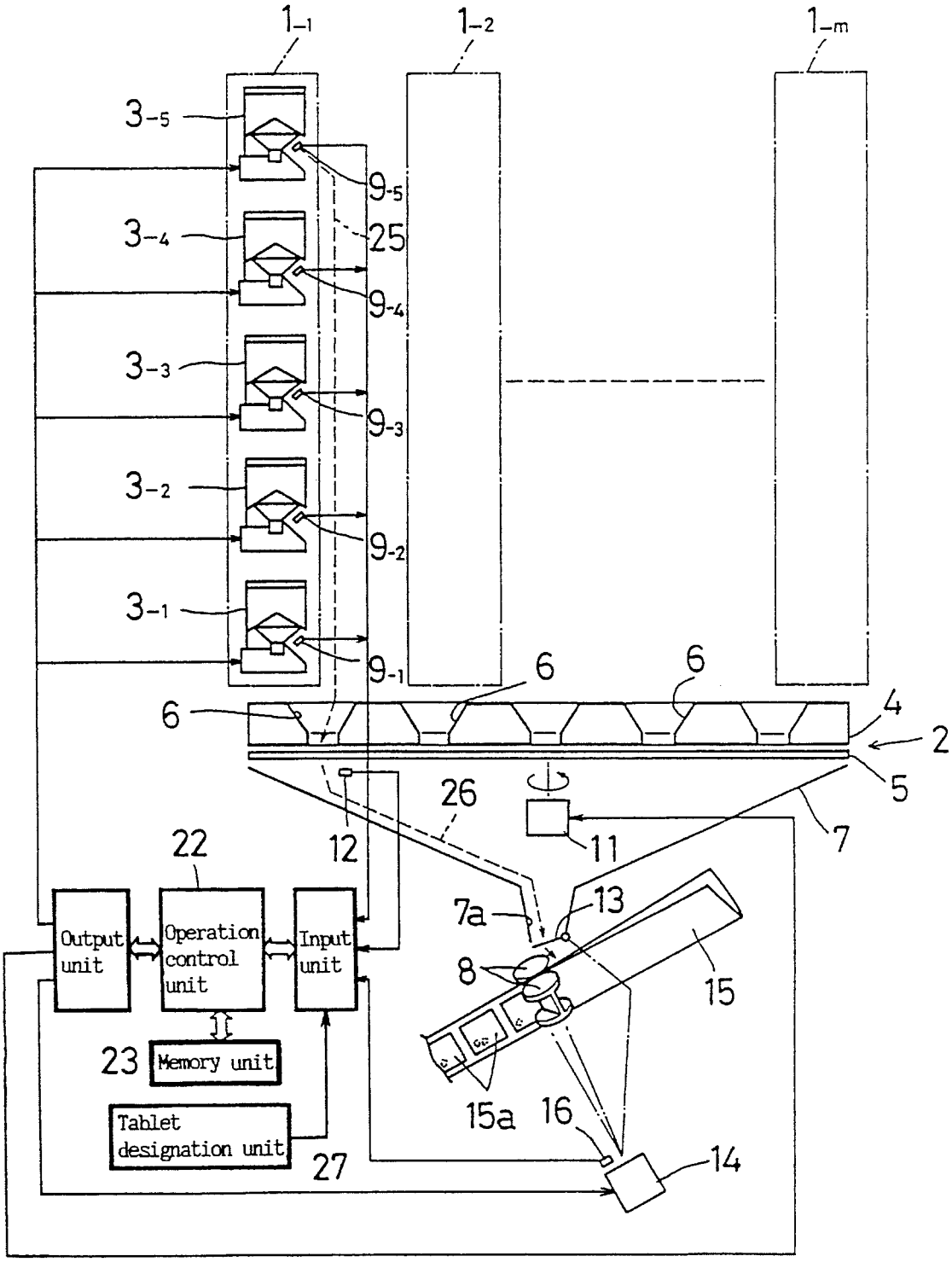
FIG. 1 is a schematic view showing one embodiment of the tablet packing device according to the present invention.

FIG. 1 schematically shows one embodiment of the tablet packing device in this invention. In FIG. 1, a plurality of feeder units 1-1 to 1-m are provided along the circumferential edge of a circular split ring unit 2. Five feeders 3-1 to 3-5 are mounted one over another in each of the feeder units 1-1 to 1-m. The split ring unit 2 comprises a pocket plate 4 at its top and a shutter plate 5 at its bottom. The pocket plate 4 is formed with a plurality of holes 6 all of which are wider at the top. Under the split ring unit 2 is mounted a funnel-shaped hopper 7, below which a pair of heater rollers 8 are provided.

The feeders 3-1 to 3-5 in the feeder units 1-1 to 1-m contain different types of tablets. Tablets are discharged one by one from the feeder 3-1 to 3-5. Also, the feeders 3-1 to 3-5 are provided with tablet sensors 9-1 to 9-5, respectively, for detecting the tablet discharged from the feeders. Each tablet sensor comprises e.g. a light-emitting element and a light-receiving element arranged oppositely, between which the tablet passes and is detected.

Figure 2A:
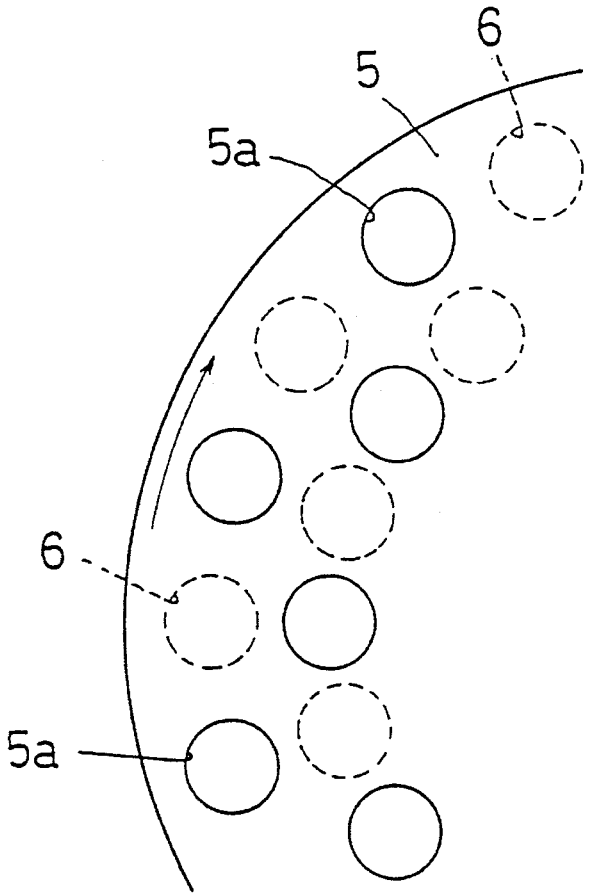
FIGS. 2A and 2B are plan views showing a split ring unit of the same.
Figure 2B:
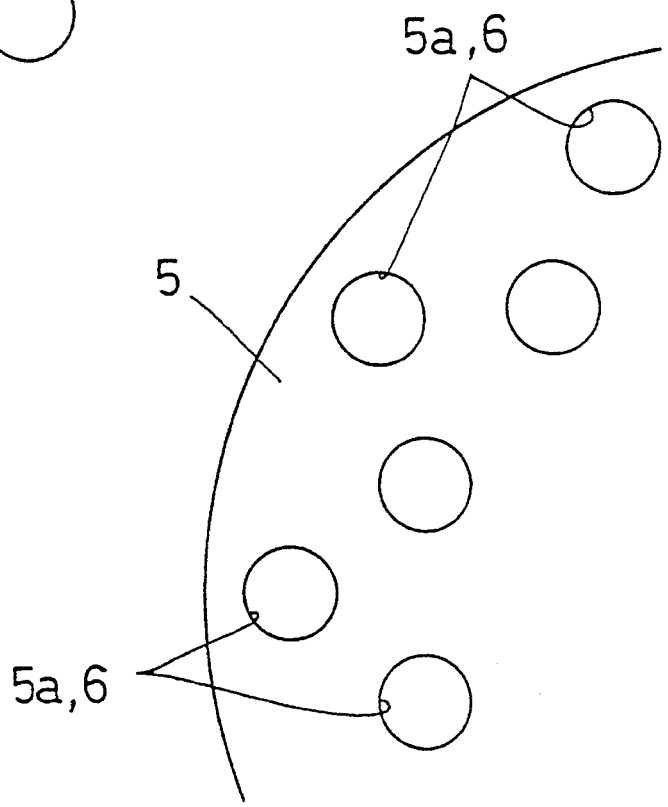

The shutter plate 5 in the split ring unit 2 is provided with a plurality of holes 5*a* (FIG. 2A) which are at least as many as the holes 6 formed in the pocket 4. A motor 11 is coupled to the shutter plate 5 through a transmission mechanism (not shown) to rotate the shutter plate 5. As shown in FIG. 2B, as the shutter plate 5 rotates, the holes 6 of the pocket plate 4 are intermittently aligned with the holes 5*a* in the shutter plate 5, so that the holes 6 are opened. Further, a switch sensor 12 is provided near one of the holes 6 in the pocket 4 to detect whether the holes 6 formed in the pocket plate 4 are opened (FIG. 2B) or closed (FIG. 2A). The switch sensor 12 also comprises a light-emitting element and a light-receiving element, between which the holes 6 are detected.

A hopper cover 13 is pivotably supported to close a hole 7*a* provided at the bottom of the hopper 7. A motor 14 is provided to pivot the hopper cover 13 through a transmission mechanism (not shown) to open and close the hopper hole 7*a*.

Figures 3, 4:
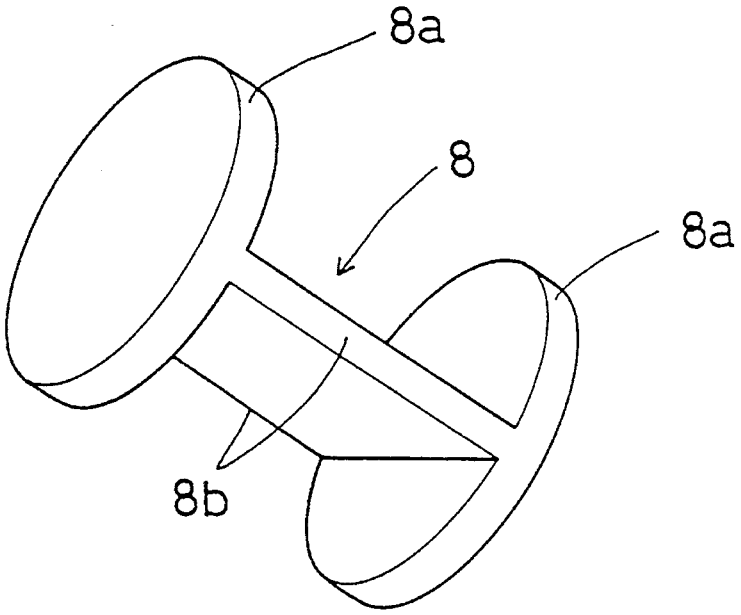

A pair of heater rollers 8 are in the shape of a cylinder partially cut off as shown in FIG. 3. Edges of the top and bottom circular plates 8*a* and of the flat center plate 8*b* generate heat. The motor 14 rotates both of the heater rollers 8 in opposite directions through a transmission mechanism (not shown). Between the heater rollers 8 is sandwiched a packing sheet 15 folded at its longitudinal center. The packing sheet 15 is fed ahead with the rotation of the heater rollers 8. A thermosensitive adhesive is applied on opposing inner surfaces of the packing sheet 15 so that they are partially heated by the edges of the heater rollers 8 and bonded to each other. In this manner, packing bags 15*a* having their periphery sealed are formed one after another.

The hopper cover 13 of the hopper 7 and the heater rollers 8 are interlocked and driven by the motor 14. In this embodiment, one packing bag 15*a* is formed by every half rotation of the heater rollers 8. During the rotation, immediately after the packing sheet 15 has been sandwiched between the edges 8*b* of the heater rollers 8 to seal its longitudinal edges, the hopper cover 13 is opened, and is closed again after a preset period of time. Right after the hopper cover 13 is closed, the position of the heater rollers 8 (hereinafter referred to as "reference position") is detected by a reference position sensor 16. An encoder may be used as the reference position sensor 16.

Outputs from the tablet sensors 9-1 to 9-5 for the feeder units 1-1 to 1-m, from the switch sensors 12 for the holes 6 and from the reference position sensors 16 for the heater rollers 8 are sent to an operation control unit 22 through an input unit 21. It controls the packing operation through an output unit 24 based on these outputs from the sensors and the data kept in a memory unit 23 in a manner described later in detail. When e.g. the feeder 3-5 in the feeder unit 1-1 is actuated to discharge a tablet therefrom, it is dropped into one of the holes 6 as shown by a dotted arrow 25. In this state, since the shutter plate 5 covers the holes 6, the dropped tablet hits and bounces on the shutter plate 5, and then stops. After it has stopped, the shutter plate 5 is rotated to open the holes 5*a* and 6 through which the tablet can be dropped. As shown by a dotted arrow 26, the tablet is slid down along the inner wall of the hopper 7 toward the hopper cover 13 and pauses. If the hopper cover 13 opens, the tablet is dropped in the packing sheet 15 which is now folded into two. Then, the heater rollers 8 make a half turn so as to seal one packing bag 15*a* containing one tablet. The same packing operation is repeated in this manner and numerous tablets are packed one after another.

On the other hand, a tablet designation unit 27 is controlled by an operator. The tablet names and their numbers are inputted according to the prescription in the operation control unit 22 from the tablet designation unit 27 through the input unit 21. They are recorded in the memory unit 23. Whenever it is necessary, the operation control unit 22 reads out from the memory unit 23 which and how many tablets are ordered and controls to pack the exact tablets in exact numbers.

In the memory unit 23 is recorded a data table 31 (shown in FIG. 4), which keeps data such as tablet names, feeder numbers where each type of tablets is accommodated, and characteristics thereof. For example, tablets A are accommodated in the feeder (1-1, 3-1), i.e. in the feeder 3-1 in the feeder unit 1-1 and given a characteristic T1.

As for the characteristic of the tablets, they are categorized into four categories T1 through T4 as shown in a data table 32 (FIG. 5) which is kept in the memory unit 23. These characteristics indicate stabilization time period "tp", i.e. the time period starting from the instant when the tablet lands to the instant when it has stopped. As will be apparent from this data table 32, the characteristic T1 is defined as an elliptical capsule having a "tp" of zero second. T2 means sugar-coated tablet having a "tp" of 0.1 second. T3 denotes an elliptical soft capsule having a "tp" of 0.2 second, and T4 does a spherical soft capsule having a "tp" of 0.3.

If one type of tablets is ordered, the feeder number containing the ordered type of tablets and its characteristic can be confirmed from the data table 31 shown in FIG. 4. Thereafter, the data table 32 shown in FIG. 5 will give its stabilization time "tp".

The types of tablets shown in this embodiment are given as a mere example. In practical use, the tablets in a variety of types are categorized into different groups, and different stabilization time periods "tp" are given to the respective groups.

A data table 33 (FIG. 6) in the memory unit 23 keeps data of feeder numbers and their characteristics which are given to the respective feeders. As for the characteristic of the feeders, they are categorized into five categories H1 through H5 as shown in a data table 34 (FIG. 7) in the memory unit 23. The characteristic "tr" denotes a delay time for the feeders at five different heights and "ts" does dropping time, i.e. time taken for it to drop. As will be apparent from the table 34, the characteristic H1 is given to the lowest feeder 3-1 and has a "tr" of 0.4 second and a "ts" of zero second. Similarly, the other characteristics H2–H5 are given to the respective feeders 3-2 to 3-5 at other four heights and indicate the respective delay times "tr" and the dropping times "ts".

The dropping time "ts" amounts to the time period from the instant when the tablet is discharged to the instant it lands the shutter plate 5. Therefore, the tablet discharged from the lowest feeder 3-1 (having a characteristic H1) has a "ts" of zero second (actually extremely short time), and the tablet discharged from the feeder 3-2 (having a characteristic H2) has a "ts" of 0.1 second. The delay time "tr" equals to the waiting time during which the tablet still stays in the feeder after it is ordered and before it is discharged therefrom. By adding this delay time "tr" to the dropping time "ts", the difference in the dropping time "ts" of the feeders 3-1 to 3-5 is compensated.

Let us assume that a tablet is discharged from the feeder 3-1 having a characteristic H1. Although the dropping time "ts" thereof is zero second, the tablet is discharged after 0.4 second (delay time "tr") has lapsed. Thus, the tablet needs 0.4 second+"to" (the actuating time for the feeder) for landing. Also, if the tablet is discharged from the feeder 3-5 having a characteristic H5, although it is discharged right away ("tr"=0 second), it takes 0.4 second for the dropping time "ts". Again, the tablet needs 0.4 second+"to" (the actuating time for the feeder) for landing. Therefore, the time required for landing will always be 0.4 second+"to" (the actuating time for the feeder) no matter which feeder discharges the tablet.

Figure 8:
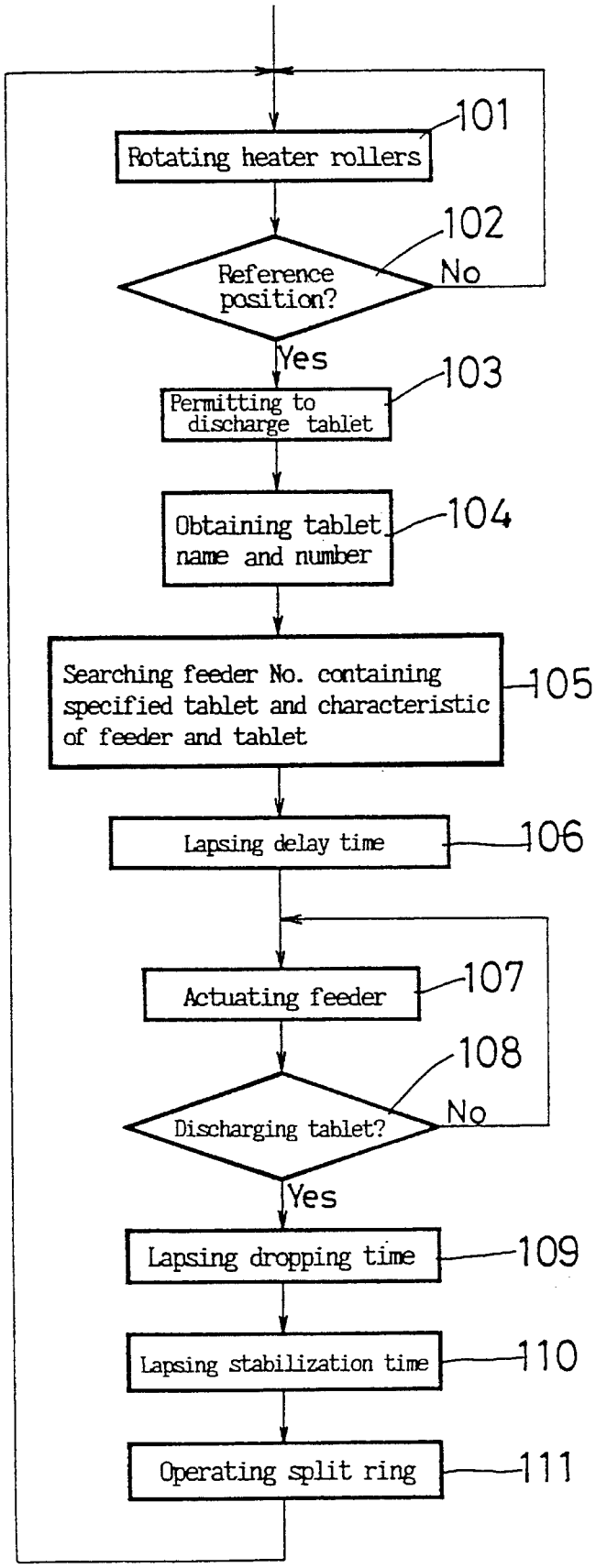
FIG. 8 is a flow chart showing how the steps proceed.
Figures 9A, 9B, 9C, 9D, 9E, 9F, 9G, 9H:
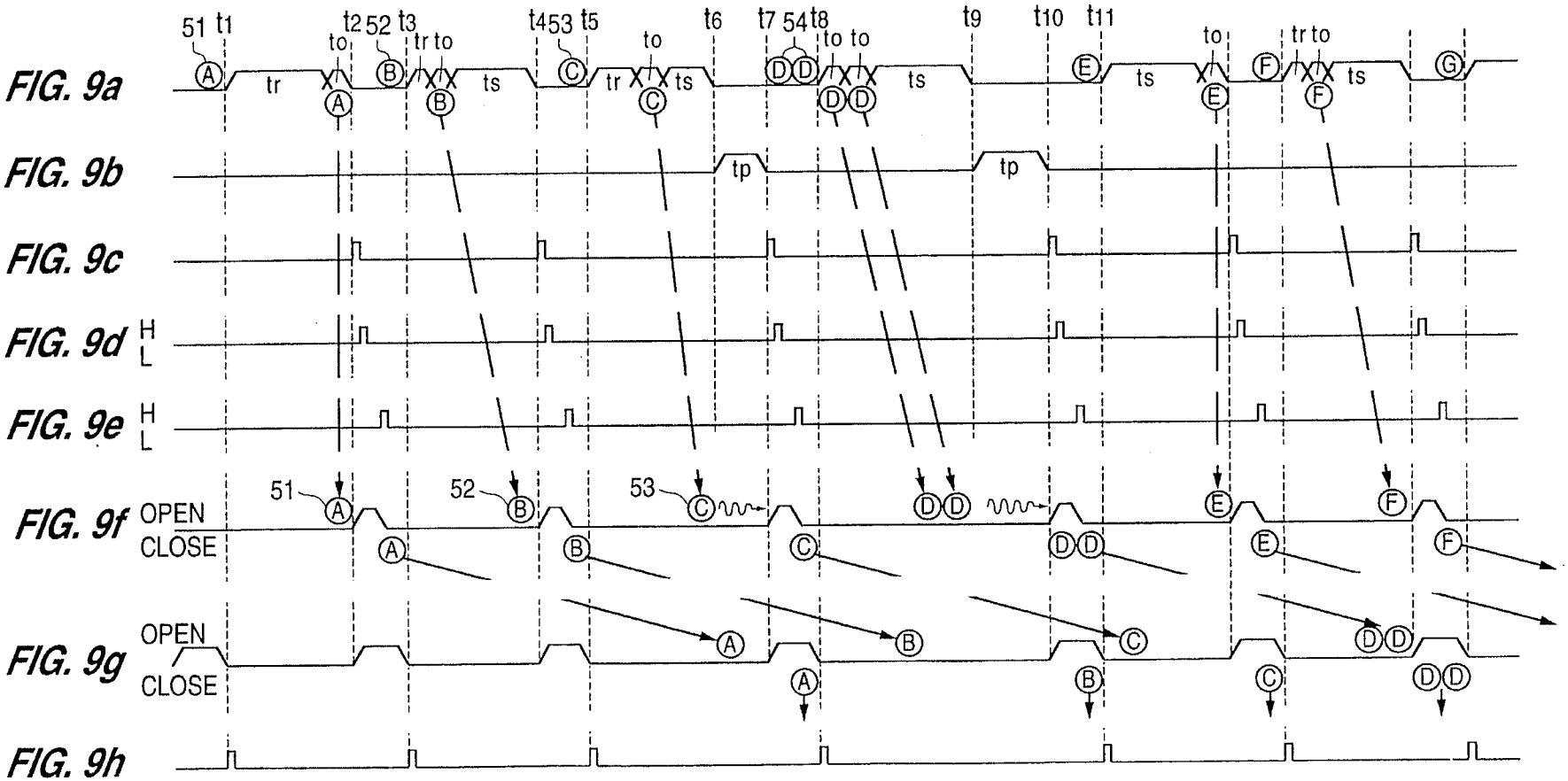
FIG. 9 is a timing chart showing how the packing operation proceeds.

In this tablet packing device as arranged above, we shall explain how tablets are discharged from the feeders 3-1 to 3-5 in the feeder units 1-1 to 1-m with reference to FIG. 8 (flow chart) and FIG. 9 (timing chart).

First, while the operation control unit 22 activates the motor 14 to rotate the heater rollers 8 (step 101 in FIG. 8), it judges whether or not the heater rollers 8 has reached the reference position based upon the output from the reference position sensor 16 (step 102 in FIG. 8). Thereafter, when the output of the reference position sensor 16 becomes high level at the point t1 at h) shown in FIG. 9, the operation control unit 22 judges that the heater rollers 8 have reached the reference position (step 102, Yes). Then, it permits the tablet to be discharged (step 103), and reads out from the memory unit 23 which and how many tablets are to be discharged (step 104).

Next, with reference to the data tables 31 to 34 in FIGS. 4–7 which are recorded in the memory unit 23, the operation control unit 22 will search the feeder number containing the tablet, the stabilization time period "tp", the delay time "tr" and the dropping time "ts" (step 105 in FIG. 8). For example, let us assume that one tablet of Tablet A is ordered and that it is accommodated in the feeder numbered (1-1, 3-1) with its stabilization time period "tp" of zero second. As the feeder number (1-1, 31) indicates that the tablet is in the feeder 3-1 in the feeder unit 1-1, its delay time "tr" and dropping time "ts" are defined as 0.4 second and zero second, respectively. In this case, as shown at a) in FIG. 9, the operation control unit 22 waits to drop the tablet from the point of time t1 (when the tablet is permitted to be discharged) until the delay time "tr" has lapsed (step 106). Thereafter, by operating the feeder 3-1 in the feeder unit 1-1 (step 107), the tablet of Tablet A is dropped therefrom (numeral 51 in FIG. 9). In this state, the operation control unit 22 actuates the feeder 3-1 until it confirms that one tablet has been discharged from the feeder 3-1 (step 108, Yes, in FIG. 8), from the output from the tablet sensor 9-1 in the feeder unit 1-1. If one tablet is discharged instantly, the feeder 3-1 is actuated for a time "to" only.

Since the tablet has the dropping time "ts" of zero second, it is immediately dropped onto the shutter plate 5 through the hole 6 (step 109 in FIG. 8). Since its stabilization time period "tp" is zero second, it stabilizes right away with no bound (step 110). Thus, immediately after the operation of the feeder 3-1 has finished, i.e. at the point t2 in FIG. 9, the operation control unit 22 starts the split ring unit 2 (step 111). The motor 11 will be actuated to rotate the shutter plate 5 and, as shown at f) in FIG. 9, the holes 6 and 5*a* are opened. The tablet 51 of Tablet A is dropped through the hole 6 into the hopper 7 and slid down. In this state, the operation control unit 22 will open the holes 6 at the bottom for a limited period of time based upon the output from the switch sensor 12 that the holes 6 are opened or closed.

While the heater rollers 8 keep rotating, the hopper cover 13 of the hopper is opened and closed from the point t2. At the point t3, the reference position sensor 16 detects that the heater rollers 8 have reached the reference position (steps 101 and 102 in FIG. 8). Since the tablet 51 of Tablet A has just been dropped through the hole 6, it will not be dropped further into the packing sheet 15 from the hole 7*a* in the hopper 7.

Next, the operation control unit 22 permits the next tablet to be discharged (step 103), and reads out from the memory unit 23 (step 104) that one tablet of Tablet B is to be discharged next.

The feeder number (1-1, 3-4) containing the tablet of Tablet B, the stabilization time period "tp" (=0 second), the delay time "tr" (=0.1 second) corresponding to the height of the feeder (3-4) and the dropping time "ts" (=0.3 second) are searched (step 105) with reference to the data tables 31 to 34 in FIGS. 4–7.

As shown at a) in FIG. 9, the operation control unit 22 waits for the delay time "tr" (=0.1 second) from the point t3 (step 106). By actuating the feeder 3-4 in the feeder unit 1-1 for the time period "to" (step 107), it controls to drop one tablet of Tablet B (shown by numeral 52 in FIG. 9) from the feeder 3-4 (step 108, Yes). After that, the operation control unit 22 waits for the dropping time "ts" (=0.3 second) until the tablet 52 lands the shutter plate 5 (step 109). As the stabilization time period "tp" of the Tablet B is zero second (step 110), at the point t4 which is immediately after the dropping time "ts" (=0.3 second) has lapsed, the operation control unit 22 will start the split ring unit 2 and the motor 11 be driven to rotate the shutter plate 5 as shown at c) in FIG. 9. The holes 6 formed in the pocket plate 4 are opened (step 111) as shown at f) in FIG. 9 and thus the tablet 52 is dropped through the hole 6 into the hopper 7.

While the heater rollers 8 keep rotating, the hopper cover 13 of the hopper 7 is opened and closed from the point t4. At the point t5, the reference position sensor 16 detects that the heater rollers 8 have reached the reference position (steps 101 and 102 in FIG. 8). Since the tablet 52 has just been dropped from the hole 6 and the preceding tablet 51 is being slid along the inner wall of the hopper 7, neither of the tablets will be dropped into the packing sheet 15 through the hole 7*a* in the hopper 7.

The next tablet is permitted to be discharged (step 103), and it is read out from the memory unit 23 (step 104) that one tablet of Tablet C will be discharged next.

The feeder number (1-1, 3-3) containing the tablet of Tablet C, the stabilization time period "tp" (=0.2 second), the delay time "tr" (=0.2 second) and the dropping time "ts" (=0.2 second) are searched (step 105) with reference to the tables 31 to 34 in FIGS. 4–7.

As shown at a) in FIG. 9, the operation control unit 22 waits for the delay time "tr" (=0.2 second). By actuating the feeder 3-3 in the feeder unit 1-1 for the time period "to" (step 107), it controls to drop one tablet of Tablet C (shown by numeral 53 in FIG. 9) from the feeder 3-3 (step 108, Yes). After that, the operation control unit 22 waits for the dropping time "ts" (=0.2 second) until the tablet 53 reaches the shutter plate 5.

Then, the operation control unit 22 waits for 0.2 second, that is, the stabilization time period "tp" of the C tablet (step 110). During this 0.2 second, the tablet bounces on the shutter plate 5 inside the peripheral wall of the hole 6 and it gradually stabilizes.

At the point t7 immediately after the stabilization time period "tp" has lapsed, the operation control unit 22 starts the split ring unit 2 and the motor 11 is driven to rotate the shutter plate 5 as shown at c) in FIG. 9. The holes 6 formed in the pocket plate 4 are opened (step 111) as shown at f) in FIG. 9 and thus the tablet 53 is dropped through the hole 6 onto the hopper 7.

While the heater rollers 8 keep rotating, the hopper cover 13 of the hopper 7 is opened and closed from the point t7 to the point t8 (steps 101, 102). In this state, since the tablet 51 has already reached the hopper cover 13, it is dropped into the packing sheet 15 through the hole 7*a* of the hopper 7.

Next, it is read out from the memory unit 23 that two tablets of Tablet D are to be discharged next (steps 103, 104).

The feeder number (1-1, 3-5) containing the tablets of Tablet D, the stabilization time period "tp" (=0.3 second), the delay time "tr" (=0 second) and the dropping time "ts" (=0.4 second) are searched (step 105) with reference to the data tables 31 to 34 in FIGS. 4–7.

With the delay time "tr" of zero second (step 106), the feeder 3-5 in the feeder unit 1-1 is activated immediately after the point t8. In order to drop two tablets (numeral 54 in FIG. 9), the feeder 3-5 is activated twice as long as the actuating time "to" (steps 107 and 108) as shown at a) in FIG. 9. After the second tablet has been discharged from the feeder 3-5, the operation control unit 22 waits for the dropping time "ts" (=0.4 second).

Thereafter, the operation control unit 22 waits for 0.3 second (the stabilization time period "tp") until the tablets stabilize in the hole 6. At the point t10 when the tablets stabilize, the operation control unit 22 starts the split ring unit 2 as shown at c) in FIG. 9. The holes 6 formed in the pocket plate 4 are opened at the bottom (step 111) as shown at f) in FIG. 9 and thus the tablets 54 are dropped through the hole 6 onto the hopper 7.

While the heater rollers 8 keep rotating further, the hopper cover 13 of the hopper 7 is opened and closed from the point t10 to the point t11 (steps 101, 102). In this state, the tablet 51 of Tablet A, already dropped in the packing sheet 15, is sealed in the packing bag 15*a* with the rotation of the heater rollers 8. Also, since the tablet 52 of Tablet B has already reached the hopper cover 13, it is dropped into the packing sheet 15 through the hole 7*a* of the hopper 7. This tablet 52 of Tablet B will be sealed in the packing bag 15*a* next time.

The same operation is repeated in this manner. Every time the tablet name is designated, the feeder number, stabilization time period "tp", delay time "tr" and dropping time "ts" are searched. After these predetermined time periods "tr" and "ts" and the feeder actuating time "to" and the stabilization time period "tp" have lapsed, the split ring unit is actuated.

As shown in FIG. 9, the first cycle from the point t1 to t3 and the second cycle from the point t3 to t5 have the same period of time. In contrast, the third cycle from the point t5 to t8 is slightly longer because the stabilization time period "tp" in the third cycle is set to be 0.2 second compared to zero second in the first and second cycles. Therefore, the third cycle is 0.2 second longer. Further, the fourth cycle from the point t8 to t11 is still longer because the feeder actuating time "to" has to be set longer to discharge two tablets and because the stabilization time period "tp" is 0.3 second. By comparing the first to fourth cycles, the longer the stabilization time period "tp", the longer the cycle becomes. In other words, the shorter the stabilization time period "tp", the shorter the cycle. Therefore, the packing device in this embodiment can provide quick packing without wasting time.

From the point t8 in FIG. 9, while the tablets 54 of Tablet D are being discharged, the tablet 53 of Tablet C is being dropped from the hole 6 formed in the pocket plate 4, and the tablet 52 of Tablet B is sliding down along the inner wall of the hopper 7. At the same time, the tablet 51 of Tablet A is dropping through the hole 7*a* of the hopper 7. Namely, all steps are carried out at the same time in a mutually overlapping manner so as to pack a variety of types of tablets. This will reduce the entire packing time. In particular, the fact that the time to transport the tablets from the feeder to the split ring unit overlaps the time to feed from the split ring unit to the hopper cover helps expedite the entire process.

In this embodiment, one type of tablet is accommodated in one packing bag, but of course it is possible to accommodate different types of tablets in one bag. In that case, a plurality of feeders are simultaneously controlled to drop different types of tablets. After the longest stabilization time period among those for different tablets is over, all the tablets are dropped from the split ring unit.

Though the tablet dropped from the feeder is stopped at the split ring unit, the latter may be omitted. If omitted, the steps are not sufficiently overlapped with one another and thus the entire packing time will be longer.

Figures 10, 11:
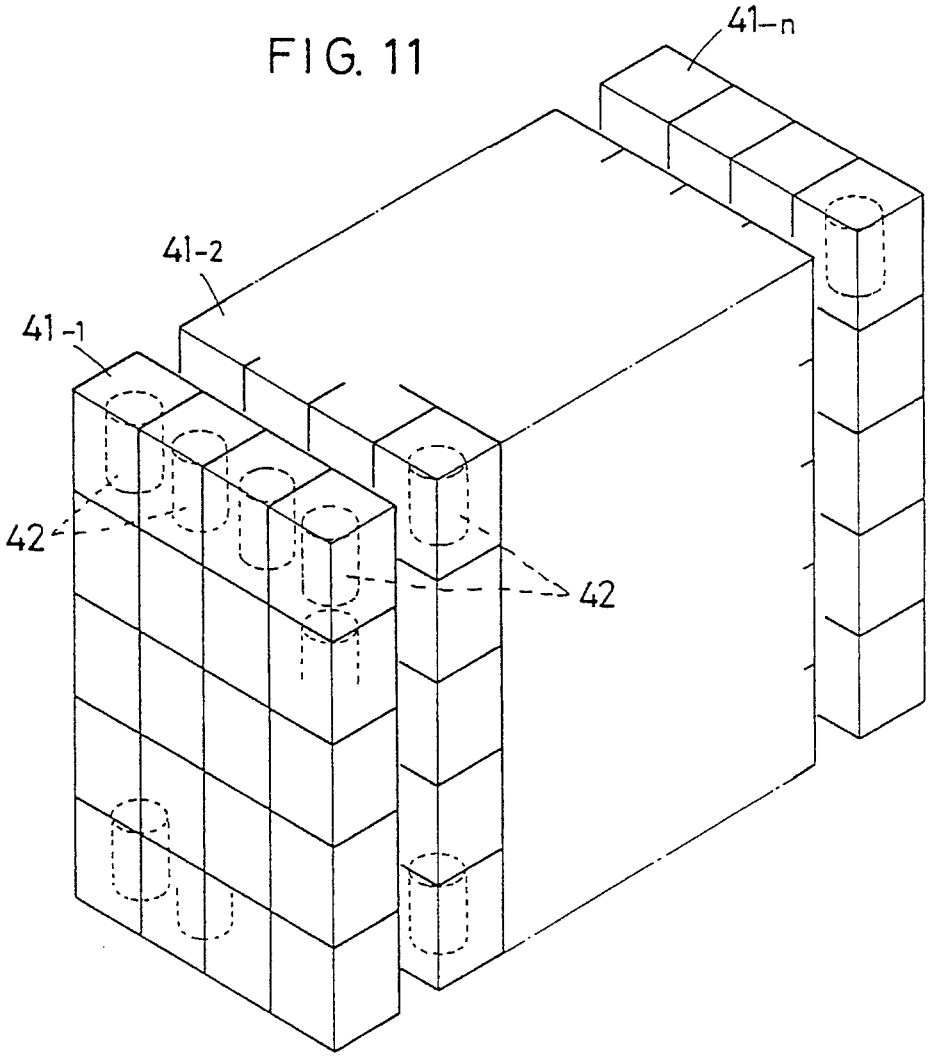
FIG. 10 shows another data table in the memory unit of the embodiment.
FIG. 11 is a perspective view showing how a plurality of feeder units are mounted.

A plurality of feeder units may not be arranged along the circumferential edge of the circular split ring unit. FIG. 11 shows One alternative in which feeder units 41-1 to 41-n are arranged linearly. In each of the feeder units are vertically and laterally mounted a plurality of feeders 42. The tablets are dropped from the feeders. With the provision of the pocket plate and the shutter plate above the hopper, the same packing operation as described above can be carried out.

Furthermore, since how much the tablets bound varies according to their dropping heights, the stabilization time period shown in the data table 32 in FIG. 5 may be corrected according to the dropping heights. For example, as shown in FIG. 10, a data table 35 having correction coefficients corresponding to the heights of the feeders may be provided. When the tablets are discharged from the feeders, the stabilization time period and the correction coefficient are read out from the data tables 32 and 35, respectively. The corrected stabilization time period can be obtained by multiplying the stabilization time period by the correction coefficient.

The lower the feeder in the feeder units is, the longer the stabilization time period of the tablet accommodated therein. In other words, if the position of the feeder is the lowest, the tablet which is most likely to bounce may be accommodated therein. This makes it possible to reduce the difference in the stabilization time periods of the tablets between the feeder at the high position and the one at the low position.

Lower feeders may accommodate the tablet type which has long stabilization time period and which is frequently used. In this arrangement, the entire processing speed becomes higher because although it needs a long time to pack unfrequently-used tablets, it takes much shorter time to pack tablets which are frequently used.

The present invention may be applicable even to the arrangement in which the feeders are arranged only laterally. The delay time and dropping time shown in the data table 34 in FIG. 7 are omitted in that case so as to simplify the control process.

What is claimed is:

1. A tablet packing device having a plurality of feeders accommodating different types of tablets, said tablets being selectively dropped from said feeders and packed, said packing device further comprising:

memory means for storing data of a time period for each type of tablets to settle down from the instant when a dropped tablet has landed; and control means for controlling said feeders to discharge one of said tablets from one of said feeders, to read out said time period specified for said one tablet from said memory means, and to drop the next one of said tablets from another one of said feeders after said time period has lapsed.

2. A method for controlling a tablet packing device, said tablet packing device having a plurality of feeders accommodating different types of tablets, said tablets being selectively dropped from said feeders and packed, said method comprising steps of:

determining beforehand a time period for each type of tablet to settle down from the instant when the tablet has been dropped; and determining a timing for dropping a second tablet after a preceding tablet is dropped from one of said feeders based upon said time period.

3. A method for controlling a tablet packing device as claimed in claim 2, wherein a timing to drop said tablet is determined by said time period and by a time period starting from the instant when the tablet is discharged from one of the feeder to the instant when it lands.

4. A method for controlling a tablet packing device as claimed in claim 2, wherein said time period for the tablet to settle down is calculated according to the height between the feeder accommodating said tablet and the landing point.

5. A tablet packing device having a plurality of vertically separated feeders accommodating different types of tablets, said tablets being selectively discharged and packed, characterized in that said tablets are categorized into groups according to the time required to settle down after they are dropped, and that the sooner the tablets settle, the tablets are accommodated in the higher of the vertically separated feeders.

6. A tablet packing device having a plurality of feeders accommodating different types of tablets, said tablets being selectively discharged and packed, characterized in that said tablets are categorized into groups according to the time required to settle down after they are dropped and the frequency in use, and that the sooner the tablets settle and the less frequently the tablets are used, the tablets are accommodated in the higher of several vertically separated feeders.

* * * * *